US006209636B1

(12) United States Patent
Roberts et al.

(10) Patent No.: US 6,209,636 B1
(45) Date of Patent: Apr. 3, 2001

(54) WELLBORE PRIMARY BARRIER AND RELATED SYSTEMS

(75) Inventors: John D. Roberts, Spring, TX (US); Jan Drechsler, Stavanger (NO); Tom Salversen, Sandnes (NO); Tom Unsgaard; Eirik Enerstvedt, both of Stavanger (NO); William A. Blizzard, Jr., Houston, TX (US); Dale E. Langford, Lafayette, LA (US); Thurman B. Carter, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/264,546

(22) Filed: Mar. 7, 1999

Related U.S. Application Data

(63) Continuation-in-part of application No. 09/183,943, filed on Oct. 3, 1998, and a continuation-in-part of application No. PCT/NO98/00037, filed on Feb. 3, 1998, application No. 08/962,162, filed on Oct. 31, 1997, now Pat. No. 6,024,168, and application No. 08/790,543, filed on Jan. 30, 1997, said application No. 08/962,162, is a continuation-in-part of application No. 08/752,359, filed on Nov. 19, 1996, now Pat. No. 5,787,978, and application No. 08/590,747, filed on Jan. 24, 1996, which is a continuation-in-part of application No. 08/414,201, filed on Mar. 31, 1995, now Pat. No. 5,531,271, application No. 08/300,917, filed on Sep. 6, 1994, now Pat. No. 5,425,417, application No. 08/225,384, filed on Apr. 4, 1994, now Pat. No. 5,409,060, application No. 08/119,813, filed on Sep. 10, 1993, now Pat. No. 5,452,759, and application No. 08/210,697, filed on Mar. 18, 1994, now Pat. No. 5,429,187, said application No. 08/752,359, is a continuation-in-part of application No. 08/655,087, filed on Jun. 3, 1996, now Pat. No. 5,620,051, application No. 08/414,338, filed on Mar. 31, 1995, now Pat. No. 5,522,461, and application No. 08/542,439, filed on Oct. 12, 1995, said application No. 08/790,543, is a continuation-in-part of application No. 08/673,791, filed on Jun. 27, 1996, which is a continuation-in-part of application No. 08/210,697, filed on Mar. 18, 1994, now Pat. No. 5,429,187, and a division of application No. 08/414,201, which is a continuation-in-part of application No. 08/300,917, which is a continuation-in-part of application No. 08/225,384, which is a continuation-in-part of application No. 08/119,813, said application No. 08/790,543, is a continuation-in-part of application No. 08/642,118, filed on May 20, 1996, and application No. 08/752,359, filed on Nov. 19, 1996, which is a continuation-in-part of application No. 08/655,087, filed on Jun. 3, 1996, which is a division of application No. 08/414,338, filed on Mar. 31, 1995, now Pat. No. 5,522,461, and a continuation-in-part of application No. 08/542,439, filed on Oct. 12, 1995.

(51) Int. Cl.[7] ..... E21B 23/04; E21B 33/127

(52) U.S. Cl. ..... 166/117.6; 166/187

(58) Field of Search ..... 166/387, 187, 166/117.5, 117.6, 386, 382

(56) References Cited

U.S. PATENT DOCUMENTS

| | | | | |
|---|---|---|---|---|
| 2,187,635 | | 1/1940 | Stamps . | |
| 2,342,884 | | 2/1944 | Moore . | |
| 2,828,823 | | 4/1958 | Mounce . | |
| 2,997,107 | | 8/1961 | Lynes . | |
| 3,044,553 | | 7/1962 | Bradley . | |
| 3,085,628 | | 4/1963 | Valone . | |
| 3,436,084 | | 4/1969 | Courter . | |
| 3,437,142 | | 4/1969 | Conover . | |
| 3,464,709 | | 9/1969 | Furgason et al. | 277/233 |
| 3,542,127 | | 11/1970 | Malone | 166/122 |
| 3,542,128 | * | 11/1970 | Owen | 166/187 |
| 3,706,342 | | 12/1972 | Woolley | 166/134 |
| 3,876,003 | * | 4/1975 | Kisling, III | 166/187 |
| 4,008,759 | | 2/1977 | Blackwell | 166/120 |
| 4,043,390 | | 8/1977 | Glotin | 166/215 |
| 4,224,987 | | 9/1980 | Allen | 166/120 |
| 4,299,397 | | 11/1981 | Baker et al. | 166/120 |
| 4,316,504 | | 2/1982 | Baker et al. | 166/53 |
| 4,421,165 | | 12/1983 | Szarka | 166/151 |
| 4,467,867 | | 8/1984 | Baker | 166/188 |
| 4,492,383 | | 1/1985 | Wood | 277/34 |
| 4,580,632 | * | 4/1986 | Reardon | 166/187 |
| 4,655,262 | | 4/1987 | Halbardier | 166/387 |
| 4,655,292 | * | 4/1987 | Halbardier | 166/187 |
| 4,708,208 | | 11/1987 | Halbardier | 166/387 |
| 4,765,404 | | 8/1988 | Bailey et al. | 166/117.6 |
| 4,794,989 | * | 1/1989 | Mills | 166/187 |
| 4,840,231 | | 6/1989 | Berzin et al. | 166/387 |

| | | | | |
|---|---|---|---|---|
| 5,046,557 | | 9/1991 | Manderscheid | 166/120 |
| 5,117,685 | * | 6/1992 | Goldschild | 166/240 |
| 5,297,634 | | 3/1994 | Loughlin | 166/387 |
| 5,318,122 | | 6/1994 | Murray et al. | 166/313 |
| 5,320,182 | * | 6/1994 | Mendez | 166/187 |
| 5,404,946 | | 4/1995 | Hess | 166/187 |
| 5,467,821 | | 11/1995 | Sieber | 166/123 |
| 5,520,252 | | 5/1996 | McNair | 166/313 |
| 5,595,247 | | 1/1997 | Braddick | 166/297 |
| 5,613,559 | | 3/1997 | Williamson et al. | 166/381 |
| 5,651,415 | | 7/1997 | Scales | 166/250.09 |
| 5,697,438 | | 12/1997 | Rehbock et al. | 166/55.7 |
| 5,697,445 | | 12/1997 | Graham | 166/313 |
| 5,718,288 | * | 2/1998 | Bertet et al. | 166/187 |
| 5,718,292 | | 2/1998 | Heathman et al. | 166/387 |
| 5,720,343 | | 2/1998 | Kilgore et al. | 166/120 |
| 5,735,350 | | 4/1998 | Longbottom et al. | 166/313 |
| 5,769,166 | | 6/1998 | Duke | 166/298 |
| 5,775,428 | | 7/1998 | Davis et al. | 166/381 |
| 5,787,978 | | 8/1998 | Carter et al. | 166/117.6 |
| 5,787,987 | | 8/1998 | Forsyth et al. | 166/313 |
| 5,813,465 | | 9/1998 | Terrell et al. | 166/298 |
| 5,833,003 | | 11/1998 | Longbottom et al. | 166/298 |
| 5,833,004 | * | 11/1998 | Coronado | 166/187 |
| 5,845,710 | | 12/1998 | Longbottom et al. | 166/313 |
| 5,862,862 | | 1/1999 | Terrell | 166/298 |
| 5,875,847 | | 3/1999 | Forsyth | 166/313 |
| 5,944,101 | * | 8/1999 | Hearn | 166/117.5 |
| 6,035,939 | * | 3/2000 | Carter | 166/117.6 |

FOREIGN PATENT DOCUMENTS

| | | | |
|---|---|---|---|
| 0 290 114 | 11/1988 | (EP) | E21B/33/129 |
| 2 308 138 | 11/1996 | (GB) | E21B/33/134 |
| 2 326 898 | 1/1999 | (GB) | E21B/7/06 |
| WO 97/45619 | 12/1997 | (WO) | E21B/7/08 |
| WO 98/12413 | 3/1998 | (WO) | E21B/20/06 |
| WO 98/36152 | 8/1998 | (WO) | E21B/33/127 |

OTHER PUBLICATIONS

Whipstocks, Operator Procedures Guide, Weatherford Enterra 1998.

* cited by examiner

*Primary Examiner*—William Neuder
(74) *Attorney, Agent, or Firm*—Guy McClung

(57) ABSTRACT

A new wellbore apparatus has been invented which, in certain aspects, has anchor apparatus for anchoring the wellbore apparatus in a bore, the anchor apparatus actuated by fluid under pressure supplied thereto, and sealing apparatus selectively inflatable to close off the bore to fluid flow therethrough, and temperature compensating apparatus for maintaining a desired fluid pressure in the sealing apparatus to prevent it from bursting or deflating. A method for closing off a bore in a well has been invented which, in certain aspects, includes installing wellbore apparatus in the bore, the wellbore apparatus comprising anchor apparatus for anchoring the wellbore apparatus in a bore, the anchor apparatus actuated by fluid under pressure supplied thereto, and sealing apparatus interconnected with the anchor apparatus and selectively inflatable with fluid under pressure to close off the bore to fluid flow therethrough, and the wellbore apparatus upon anchoring in the bore and inflation of the sealing apparatus including a primary barrier in the bore.

54 Claims, 8 Drawing Sheets

WELLBORE PRIMARY BARRIER AND RELATED SYSTEMS

RELATED APPLICATIONS

This is a continuation-in-part of U.S. application Ser. No. 09/183,943 filed Oct. 3, 1998 and of Patent Cooperation Treaty Application No. PCT/NO98/00037 filed Feb. 3, 1998, both of which are incorporated fully herein for all purposes.

This is a continuation-in-part of U.S. application Ser. No. 08/962,162 filed Oct. 31, 1997 entitled "Wellbore Mills and Methods" now U.S. Pat. No. 6,024,168 which is a continuation-in-part of U.S. application Ser. No. 08/752,359 filed Nov. 19, 1996 entitled "Multi-Face Whipstock With Sacrificial Face Element" now U.S. Pat. No. 5,787,978 and of U.S. application Ser. No. 08/590,747 filed Jan. 24, 1996 entitled "Wellbore Milling Guide." U.S. application Ser. No. 08/590,747 is a continuation-in-part of U.S. Ser. Nos. 08/414,201 filed Mar. 31, 1995 now U.S. Pat. No. 5,531,271; 08/300,917 filed Sep. 6, 1994; now U.S. Pat. No. 5,425,417; 08/225,384 filed Apr. 4, 1994 now U.S. Pat. No. 5,409,060; 08/119,813 filed Sep. 10, 1993 now U.S. Pat. No. 5,452,759; 08,210,697 filed Mar. 18, 1994 now U.S. Pat. No. 5,429,187. U.S. application Ser. No. 08/752,359 is a continuation-in-part of U.S. Pat. Nos. 5,620,051 issued Jun. 3, 1996 and 5,522,461 issued Mar. 31, 1995; and of U.S. application Ser. No. 08/542,439 filed Oct. 12, 1995.

This is a continuation-in-part of pending U.S. application Ser. No. 08/790,543 which was filed Jan. 30, 1997 entitled "Wellbore Milling & Drilling" which is a continuation-in-part of pending U.S. application Ser. No. 08/673,791 filed on Jun. 27, 1996 entitled "Wellbore Securement System, " which is a continuation-in-part of U.S. application Ser. No. 08/210,697 filed on Mar. 18, 1994 entitled "Milling Tool & Operations" now U.S. Pat. No. 5,429,187 issued Jul. 4, 1995 and is a division of application Ser. No. 414,201 filed on Mar. 31, 1995 entitled "Whipstock Side Support" now U.S. Pat. No. 5,531,271 issued Jul. 2, 1996, which is a continuation-in-part of U.S. application Ser. No. 08/300, 917, filed on Sep. 6, 1994 entitled "Wellbore Tool Setting System" now U.S. Pat. No. 5,425,417 issued Jun. 20, 1995 which is a continuation-in-part of U.S. application Ser. No. 08/225,384, filed on Apr. 4, 1994 entitled "Wellbore Tool Orientation," now U.S. Pat. No. 5,409,060 issued on Apr. 25, 1995 which is a continuation-in-part of U.S. application Ser. No. 08/119,813 filed on Sep. 10, 1993 entitled "Whipstock System" now U.S. Pat. No. 5,452,759 issued on Sep. 26, 1995. This is a continuation-in-part of U.S. application Ser. No. 08/642,118 filed May 20, 1996 entitled "Wellbore Milling System" and of U.S. application Ser. No. 08/752, 359 filed Nov. 19, 1996 entitled "Multi-Face Whipstock With Sacrificial Face Element" which is a continuation-in-part of pending U.S. application Ser. No. 08/655,087 filed Jun. 3, 1996 entitled "Whipstock" which is a division of U.S. application Ser. No. 08/414,338 filed Mar. 31, 1995 entitled "Mill Valve" issued as U.S. Pat. No. 5,522,461 on Jun. 4, 1996, and a continuation-in-part of U.S. application Ser. No. 08/542,439 filed Oct. 12, 1995 entitled "Starting Mill and Operations." All applications cited above are co-owned with the present invention and incorporated herein in their entirety for all purposes.

BACKGROUND OF THE INVENTION

1. Field of the Invention

This invention is related to wellbore operations and, in certain particular aspects, to systems for providing primary barriers in wellbores and temperature compensation for fluid actuated apparatuses.

2. Description of Related Art

Often in a wellbore or within a tubular member in a wellbore it is desirable to have an effective sealing barrier between an upper portion of the wellbore or tubular and a lower portion thereof. A variety of prior art bridge plugs and cement systems provide barriers in wellbores and tubulars. Such a barrier is, preferably, impervious to fluids in the wellbore or tubular; unaffected by temperatures encountered in the wellbore or tubular; and strong enough and sufficiently securely emplaced to withstand forces thereon, e.g. by a dropped tool or piece of equipment.

Prior art fluid set bridge plugs can burst or deform when subjected to unusually high temperatures and may deform or shrink when subjected to unusually low temperatures - either of which temperature changes can impair their proper functioning.

FIG. 1 shows a typical prior art cement system in which cement C has been emplaced through a bull plug and hardened above and below an inflated packer P. The cement below the packer has sealed off a lower set of perforations R and has sealed off the interior of a casing S below an upper set of perforations T so that fluids from a formation F may flow to a production string G and then to surface collection equipment. Installation of a system as shown in FIG. 1 is a complex, expensive, time-consuming job.

Typical inflatable packers and other wellbore tools and apparatuses operated by fluids can be adversely affected when the temperature of actuating fluid changes or when the temperature of fluids contacting the apparatus changes. Also various fluid actuated anchor devices can be adversely affected by such temperature changes.

There has long been a need for an effective and efficient wellbore barrier that is not adversely affected by temperature changes within the wellbore or within a tubular member within which the barrier is emplaced. There has long been a need for such a barrier that serves as a primary barrier which is so securely emplaced that certain forces encountered in a wellbore are insufficient to dislodge, penetrate, or move the barrier. There has long been a need for temperature-compensated apparatus for wellbore operations which include a temperature compensating system so that temperature changes encountered in a wellbore do not adversely affect operation of the apparatuses.

SUMMARY OF THE PRESENT INVENTION

The present invention, in certain aspects, provides a wellbore apparatus that is actuated by fluid under pressure or in which certain mechanisms are moved or held in position, selectively or otherwise, by fluid (hydraulic or pneumatic) under pressure in combination with a temperature compensating system that accounts for and counters the effects of temperature changes imposed on the wellbore apparatus while it is positioned within a wellbore or within a tubular member of a tubular string within a wellbore and, in one aspect, maintains constant or nearly constant internal fluid pressure in the mechanism. Such an apparatus is, in one aspect, a "through-tubing" apparatus.

In one particular aspect an inflatable packer system is provided that has a temperature compensating system that maintains the temperature of fluid within the packer at a desired level so that the packer does not inadvertently deflate. In another aspect such a packer system includes a wellbore anchor apparatus (such as any known wellbore anchor or anchor device, mechanically and/or hydraulically actuated, regular set or through-tubing). In one aspect, the anchor is set prior to packer inflation which may greatly facilitate packer inflation in a wellbore with fluid cross flow. In another aspect (with or without the anchor apparatus) a diverter or whipstock is connected above the packer (any known whipstock or diverter; orientable; solid, hollow-filled, or hollow; through-tubing; and/or retrievable). Such a whipstock may be set either on the low side or high side of casing.

Mill guide systems as disclosed in U.S. Pat. No. 5,727,629 issued Mar. 17, 1998 and in pending U.S. application Ser. No. 08/962,162 filed Oct. 31, 1997 are anchored in a wellbore or in a tubular with an anchor device. A mill guide system according to the present invention includes an anchor apparatus as disclosed herein with a thermal compensator as disclosed herein. In one aspect such a thermal compensator has a hollow piston with differential piston surfaces mounted concentrically in a chamber around the mill guide.

In another embodiment of the present invention a packer system is provided that includes an inflatable packer and a wellbore anchor apparatus (as discussed in the preceding paragraph) including, but not limited to hydraulically (or pneumatically) selectively settable anchor devices for wellbore tools as disclosed in the prior art, e.g. but not limited to, as used to anchor a whipstock.

Systems as described herein may be run down hole in a wellbore on: a typical tubular string, e.g. but not limited to, a string of tubing or casing; on coiled tubing; on a wireline (e.g. with a selectively actuatable pump using either wellbore fluid or a fluid charge stored therein to actuate a fluid actuated apparatus or apparatuses, which apparatus(es) in one aspect are selectively releasable from the pump and wireline); pipe; and/or snubbing pipe. Sealing apparatus as disclosed here may be used to close off a wellbore, casing in a main or lateral wellbore, and/or a liner in a main or lateral wellbore—and such sealing apparatus may be selectively deflatable and/or retrievable and, in one aspect, may be used with anchor apparatus and/or temperature compensating apparatus as disclosed herein. Systems as disclosed herein may be set in perforated casing. Systems as disclosed herein may be used in milling a window in perforated casing. In one aspect a system as disclosed herein that includes an anchor, a sealing apparatus such as an inflatable sealing packer or sealing plug, and whipstock apparatus is no more than about 10 meters in length.

It is also within the scope of this invention to provide a fluid powered and/or selectively actuated wellbore anchor apparatus with a temperature compensating system that maintains fluid temperature within the anchor apparatus at a desired level or within a desired range so that temperature changes imposed on the anchor apparatus do not adversely affect its operation or result in its deactivation and unwanted movement. It is to be understood that any anchor apparatus disclosed herein may be used to anchor in a wellbore or within a tubular in a wellbore.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide a fluid activated and/or powered wellbore apparatus (or apparatuses) with a temperature compensator;

Such an apparatus which is a packer or an anchor; and

Such an apparatus that includes a packer, an anchor, and, in one aspect, a whipstock or diverter;

It is also, therefore, an object of at least certain preferred embodiments of the present invention to provide an inflatable packer with a wellbore anchor device or apparatus; and to provide new, useful, unique, efficient, nonobvious devices and methods for selective re-entry of multi-lateral bores branching from a main wellbore.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
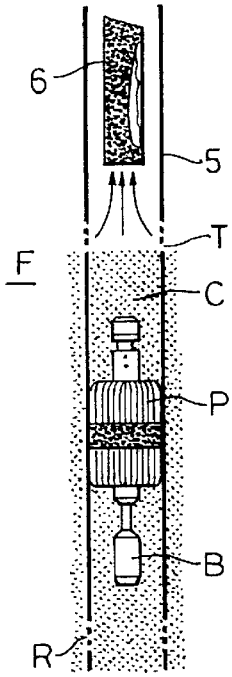
Fig. 1 PRIOR ART
FIG. 1 is a side schematic view of a prior art system.
Figure 2:
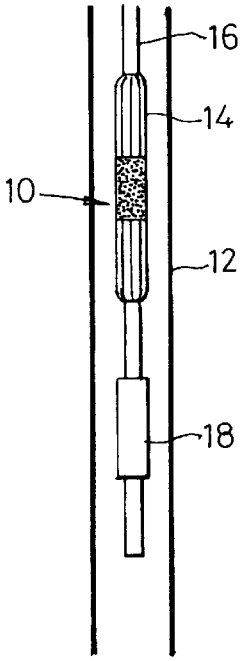
FIG. 2 is a side cross-section view of a system according to the present invention.

FIG. 2 shows a system 10 according to the present invention in a casing 12 within an earth wellbore (not shown) that extends up to the earth surface (not shown). An inflatable packer 14 is connected to a tubular string 16 which extends up to the earth surface. A temperature compensator 18 is connected to and below the inflatable packer 14. The inflatable packer 14 may be any known suitable inflatable wellbore packer or inflatable plug.

Figure 3:
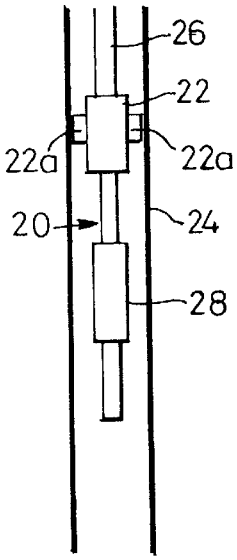
FIG. 3 is a side cross-section view of a system according to the present invention.

FIG. 3 shows a system 20 according to the present invention with a fluid operated anchor apparatus 22 connected to a tubular string 26 that extends upwardly within casing 24 to the earth's surface (not shown). The anchor apparatus 22 secures the system 20 in place in the casing 24. In one aspect, the anchor apparatus 22 is selectively actuatable and selectively disengageable from the casing. A temperature compensator 28 is connected to and below the anchor apparatus 22. (It is within the scope of this invention for any temperature compensator disclosed herein to be above or adjacent any apparatus.) The anchor apparatus 22 may be any known fluid operated wellbore anchor apparatus, including, but not limited to anchor devices with extendable slips for engaging a casing's interior or with extendable piston's for doing so. In certain aspects it is preferred that the anchor apparatus be disposed substantially symmetrically in the casing as viewed from above. As shown, selectively extendable members 22*a* have been extended and secure the system in the casing 24.

Figure 4:
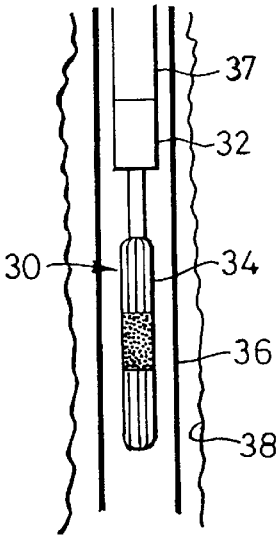
FIG. 4 is a side cross-section view of a system according to the present invention.

FIG. 4 shows a system 30 with an anchor apparatus 32 (like the anchor apparatus 22) connected to and above an inflatable packer 34 (like the packer 14). The anchor apparatus 32 (not yet activated as shown in FIG. 4) is connected to a tubular string 37 that extends up to the earth surface (not shown) within a casing 36 in a wellbore 38 that extends up to the earth surface. The string 37 (as may other strings disclosed herein) may be a hollow tubular string, coiled tubing, or a wireline.

Figure 5:
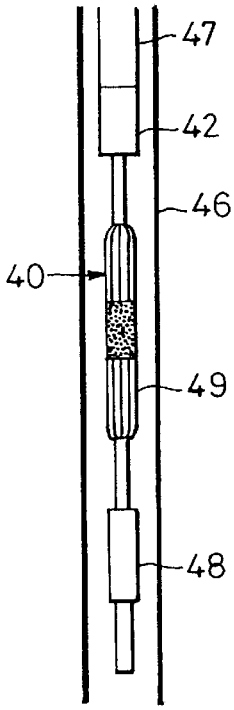
FIG. 5 is a side cross-section view of a system according to the present invention.

FIG. 5 shows a system 40 with an anchor apparatus 42 not yet selectively actuated, (like the anchor apparatuses 22, 32) connected to a tubular string 47 that extends up to the earth surface (not shown) in casing 46 within a wellbore (not shown, like wellbore 38). An inflatable packer 44 (like the packer 14) is connected to and below the anchor apparatus 42 and a thermal compensator 48 is connected to and below the inflatable packer 44. With any system herein component parts (e.g. anchors, packers, compensators may be interconnected with suitable couplings, subs, or connectors and/or to each other.

Figure 6:
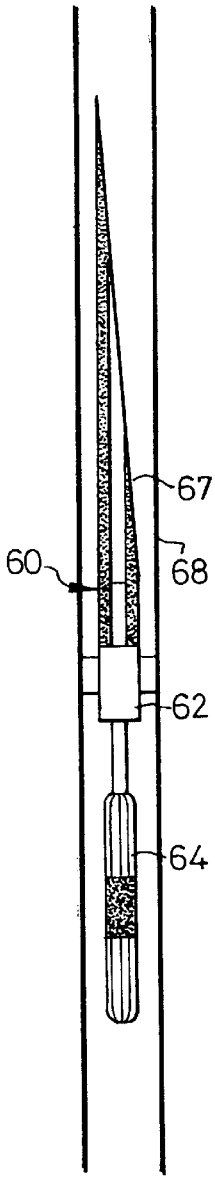
FIG. 6 is a side cross-section view of a system according to the present invention.

FIG. 6 shows a system 60 according to the present invention with an inflatable packer 64 (like the packer 14) connected to and below an anchor apparatus 62 (like the anchor apparatus 22) which is anchored within a casing 68 in an earth wellbore (not shown), the casing extending up to the earth's surface. A whipstock 67 is connected to the anchor apparatus 62 and may be any known suitable whipstock or diverter used in wellbore operations, including, but not limited to a retrievable or non-retrievable; solid, hollow-filled, or hollow whipstock; and/or a through-tubing whipstock (as may be any whipstock disclosed herein).

The packers shown in FIGS. 2 and 4–6 are shown uninflated. Each packer is selectively inflatable as is well known to one skilled in the art. The systems of FIGS. 3–6 provide a primary barrier within their respective casings that is secured in place and effectively seals off the casing interior to fluid flow. The temperature compensators of FIGS. 2, 3 and 5 prevent temperature changes within the casing from resulting in bursting or deflation of the packer in each system.

Figure 7A:
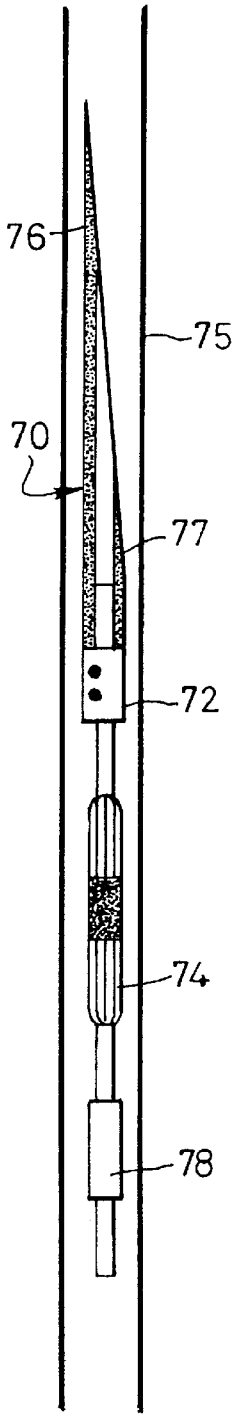
FIGS. 7A and 7B are side cross-section views of a system according to the present invention.
Figure 7B:
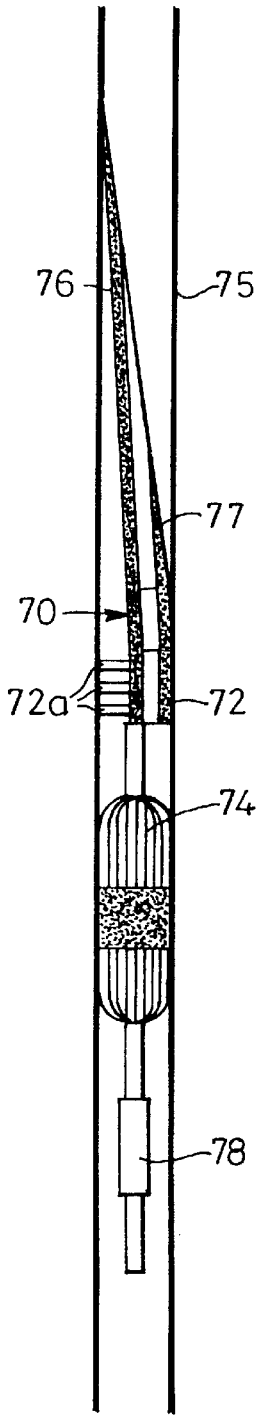

FIGS. 7A and 7B show a system 70 according to the present invention with a temperature compensator 78 connected to and below an inflatable packer 74 (like the packer 14) which is connected to and below an anchor apparatus 72 (like the anchor apparatus 22). A whipstock 77 (like the whipstock 67) is movably (e.g. tiltably) connected to and above the anchor apparatus 72.

As shown in FIG. 7B, the anchor apparatus 72 has been selectively actuated from the surface and moved by extendable members 72*a* projecting out of a side of the anchor apparatus to one side of the casing 75 and a top 76 of the whipstock 77 has tilted against an opposite side of the casing 75. The casing 75 extends up within a wellbore (not shown) to the earth's surface. As shown in FIG. 7B the packer 74 has been selectively inflated to seal off flow through the casing 75. In one particular aspect the anchor apparatus has as extendable members a main piston that projects out from the anchor apparatus to contact the casing and move the bottom of the whipstock against one side of the casing, providing significant anchoring force. Two other projecting pistons, each set about 90° apart from the main piston and contacting the casing provide stability and some anchoring force. Such an anchor apparatus will function properly in oval or uncemented casing.

FIGS. 8A–8D show temperature compensating systems according to the present invention that include one or more packers or downhole seals of the inflatable balloon type, formed to sealingly bear, in use, by its outer circumferential surface on, for example, the inner shell surface of a tubular or production riser. To prevent the pressure inside the inflated seal, because of temperature variations, getting so high that the packer seal bursts, or so low that the seal loosens and loses or reduces its effect, the seal has thereto connected a compensator which is arranged to adjust the internal pressure of the inflated seal in relation to the pressure of the surroundings on the underside/downstream of the seal, which will thus make a true reference pressure for the internal pressure of the seal and compensate for temperature differentials encountered in the wellbore that could adversely affect the plug, packer, or seal. By increasing pressure inside the inflated seal the ambient pressure permits a leakage of the liquid/gaseous inflating medium of the seal to maintain a largely constant internal pressure in the seal, whereas by a falling pressure inside the seal, the ambient pressure causes it to rise by supplying additional inflating medium from a reservoir to maintain a pressure desired for the seal, plug, or packer.

Figure 8A:
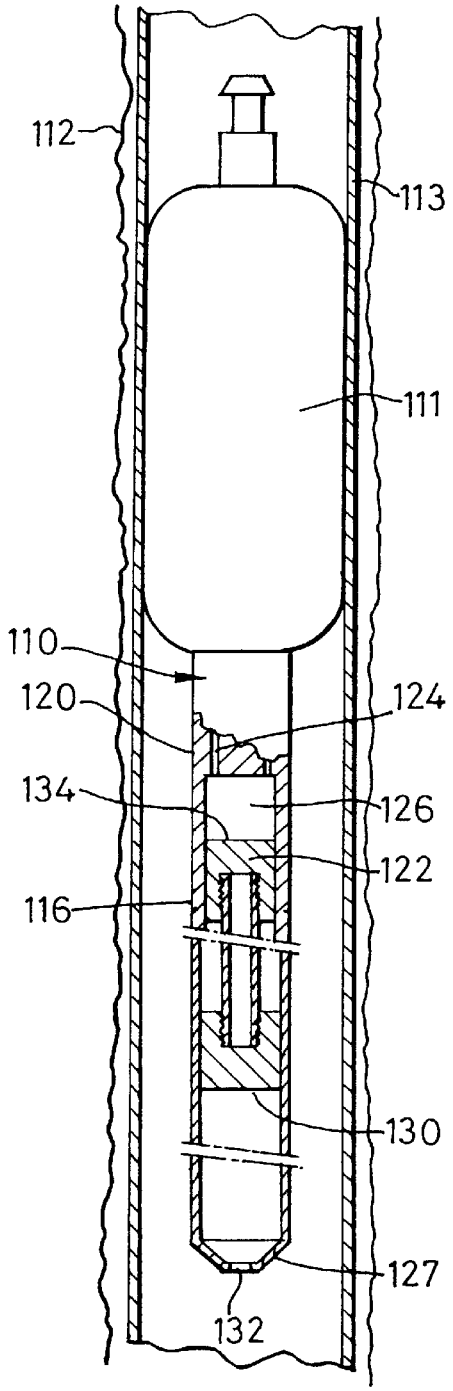
FIGS. 8A–8C are side cross-section views of temperature compensating systems according to the present invention.

FIG. 8A shows a system 110 according to the present invention which includes a wellbore apparatus 111 which may be any fluid activated and/or fluid powered wellbore tool, device or apparatus. As shown, the wellbore apparatus 111 is an inflatable packer for use in a well 112 in connection with oil/gas production. The apparatus 111 is arranged to work at well pressure and is formed to enable itself to be set and kept in position, sealingly bearing against the adjacent tube shell surface, for example the inner surface of a casing or production riser 113 by means of compressive forces which are subject to variations compensated for by means of a compensator 116. The compensator 116 is connected to and in fluid communication with the apparatus 111 and has a cylinder 120 in which is displaceably positioned a reciprocatingly slidable piston 122, which is brought to move on the occurrence of compensatable temperature variations. The apparatus 111, which is in this case an inflatable packer, is in fluid communication with the cylinder 120, and a piston 122 has a first piston surface 134 which is influenced by the pressure inside the packer 111, and a second piston surface 130 facing the opposite direction which is influenced by the pressure in the well. The two piston surfaces have mutually different areas, the pressure compensator 116 being arranged to regulate, on the basis of this difference in piston surface area, the internal pressure in the inflated packer 111 in relation to the ambient pressure (well pressure) effective downstream of the packer 111 and thus constituting a reference pressure for the internal pressure of the packer 111. Such a system is described in detail in pending PCT application PCT/NO98/00037 incorporated fully herein for all purposes and a copy of which is appended hereto as part hereof.

Although they are not equivalent, it is within the scope of this invention to use, instead of the particular thermal compensators disclosed in the specific embodiments described herein, a spring loaded thermal compensator or a gas charged thermal compensator.

Figure 8B:
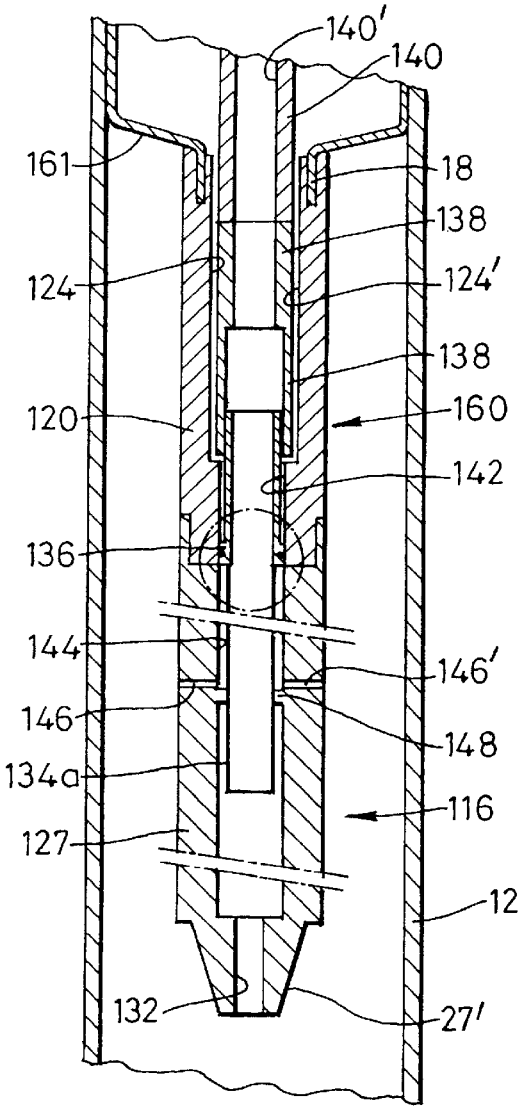

Reference is now made to an embodiment 160 according to FIGS. 8A and 8B, which is different from the described embodiment according to FIG. 8A in (a) the configuration of the piston device, (b) a central through passage for the transportation of desired fluid (oil) from an underlying formation zone through an above lying formation zone producing undesired fluid (water), and (c) the use of two opposite downhole seals (only one of these identical seals is shown) axially spaced. In this embodiment of FIGS. 8B and 8C a central, tubular piston rod 134*a* is formed with an annular piston 136 having a first piston surface 136' (see FIG. 8D) which faces an inflated seal or packer 161, and which has a considerably smaller surface area than a second piston surface 136" which faces a free end 127' of a compensator 16. The surface area proportion may for example be (but is not limited to) 1:6, such as in the embodiment of FIG. 8A.

Figure 8C:
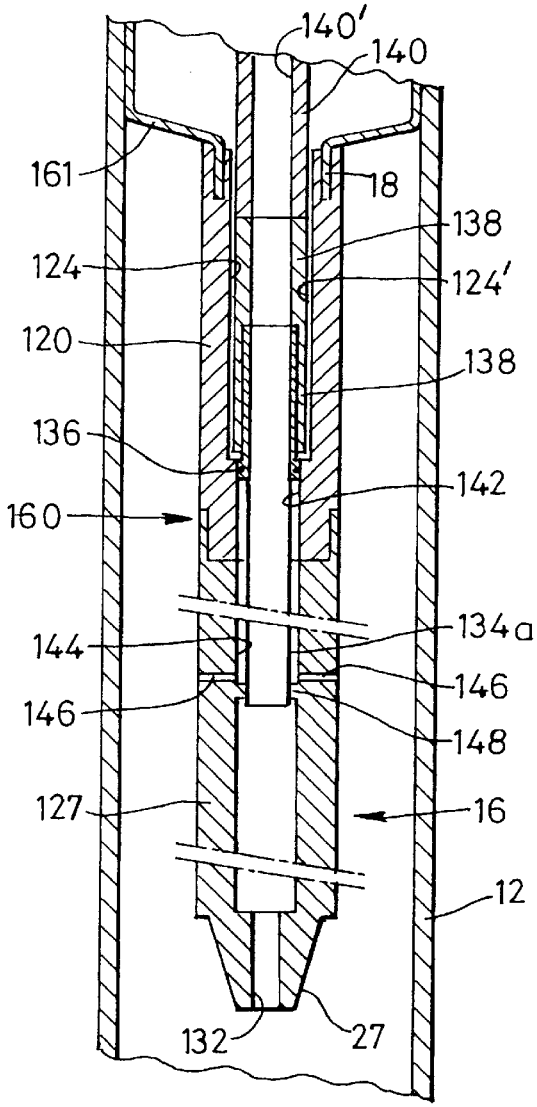
Figure 8D:
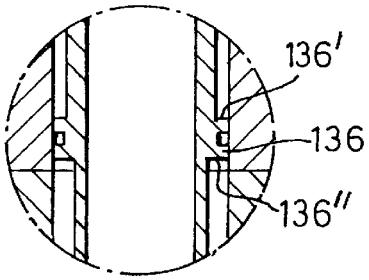
FIG. 8D is an enlargement of part of the system of FIG. 8B.

According to FIGS. 8B and 8C an upper end portion of the central, tubular piston rod 134*a* is in axially displaceable engagement with a lower tube section 138' of a concentric inner tube 138 of a first piston of an upper cylinder housing 120, said inner tube 138 being connected end-to-end to a coaxial tube 140 which has a bore 140' extending through the inflated seal 161. Said tube section 138' which has a comparatively large diameter and in a tightening manner grips around the piston rod 134*a,* is surrounded, like the rest of this tube 138, by longitudinal channels 124, 124' (alternatively by a concentric annulus) which, according to FIG. 8B, are continued by a cylinder bore 142 extending downwards, the cylindrical bore 142 being continued with the same radius as that of a coaxial cylinder bore 144 of the lower cylindrical piston housing 127. FIG. 8C shows a limit position for the piston rod/piston 134*a*/136 in said upper cylindrical housing.

In this embodiment in which, in one aspect, are used two comparatively widely spaced, symmetrically placed, inflated downhole packers or seals 161, the lower cylindrical piston housing 127 shown is provided, at a suitable point of its axial length, with mainly radially directed ports 146, 146', the cylinder bore 144 immediately below the ports 146, 146' being provided with a radially inward annular flange with a seal 148 tightening around the tubular piston rod 134*a*. The free end 127' has a bore 132.

Figure 9:
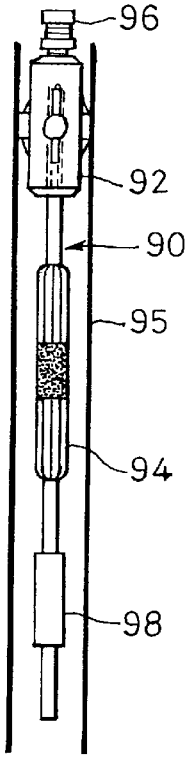
FIG. 9 is a side cross-section view of a system according to the present invention.

FIG. 9 shows a system 90 according to the present invention with a thermal compensator 98 connected to and below an inflatable packer 94 (like the packer 14) which is connected to and below an anchor apparatus 92. The anchor apparatus 92 is an hydraulic hold-down anchor apparatus as disclosed in pending U.S. application Ser. No. 09/183,943 filed Oct. 31, 1998 and co-owned with the present invention. The anchor apparatus 92 is symmetrically centered within casing 95 that extends up in an earth wellbore (now shown) to the earth surface and is connected to a tubular string 96 that extends up to the earth surface within the casing 95.

Figure 10A:
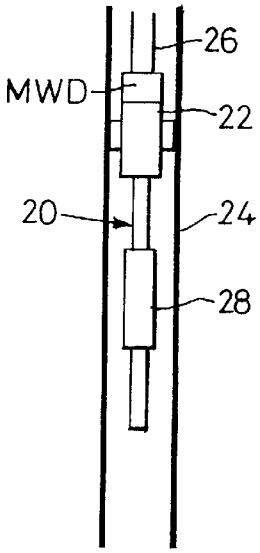
FIGS. 10A–10D are side cross-section views of systems according to the present invention.
Figure 10B:
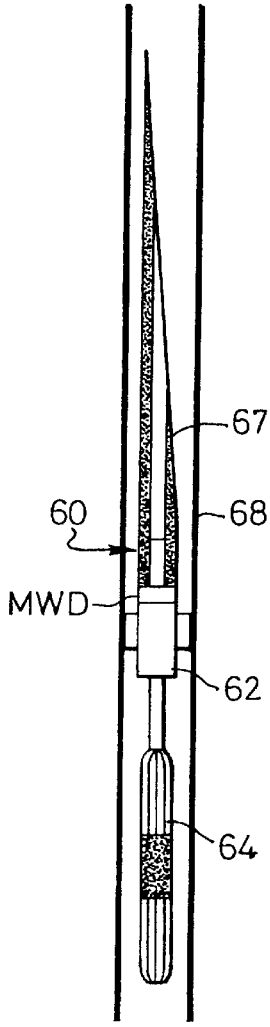

FIG. 10A shows a system 20 as in FIG. 3 with an orienting apparatus for orienting the anchor apparatus 22. In one aspect the orienting apparatus is a measurement-while-drilling apparatus MWD. Such an MWD apparatus may be positioned anywhere in the system that is suitable for proper operation. It is shown schematically connected to the anchor apparatus 22 but, as desired, it may be spaced-apart therefrom or positioned therebelow, or below the temperature compensator. Any system disclosed herein (FIGS. 2–18) may use an orienting apparatus which, in one aspect, may be an MWD apparatus positioned anywhere as discussed above. FIG. 10B shows a system 60 as in FIG. 6 with an MWD apparatus above its anchor 62.

Figure 10C:
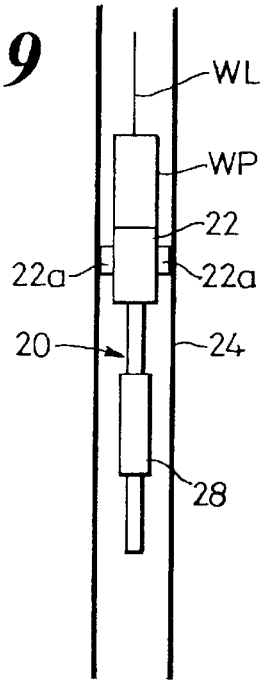
Figure 10D:
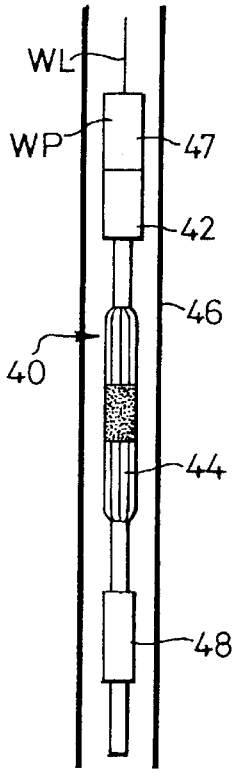

FIG. 10C illustrates that systems according to the present invention that have a fluid actuated device may be run downhole on a wireline with a selectively actuatable pump that, in one aspect, is releasably connected to the fluid actuated device. By way of example FIG. 10C shows a system 20 as in FIG. 3 releasably connected to a pump WP on a wireline WL that extends in casing 24 to the earth's surface. Selectively actuation of the pump forces wellbore fluid and/or a fluid charge releasably stored within the pump to the anchor apparatus 22 to extend the projecting members 22*a* to anchor the system in the casing 24. FIG. 10D shows a system 40 as in FIG. 5 on a wireline WL with a pump WP like the wireline and pump of FIG. 10C.

Figure 11:
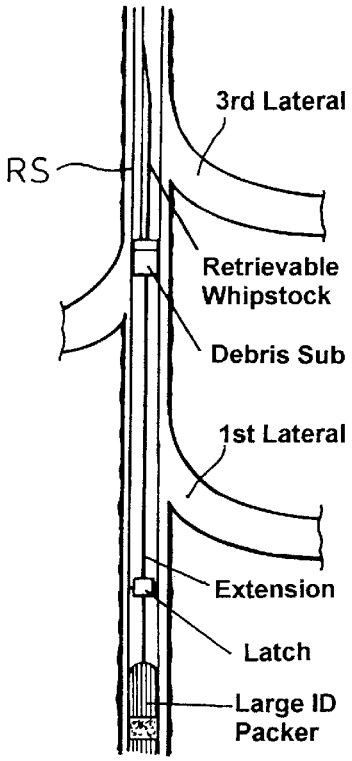
Fig. 11 PRIOR ART
FIG. 11 is a schematic view of a prior art multi-lateral wellbore selective re-entry system.

FIG. 11 shows a prior art multi-lateral wellbore selective reentry system RS which has a retrievable whipstock anchored in casing with a prior art wellbore anchor system and a large ID mechanically set packer for sealing off the casing. A main parent wellbore has three lateral wellbores (or "sidetracks") branching off from it. The system RS makes possible numerous sidetracks from the parent wellbore, while providing the ability to mill lateral windows in close proximity to one another. Any specific sidetracked lateral can be re-entered at any time, with simultaneous parent wellbore accessibility.

Figure 12A:
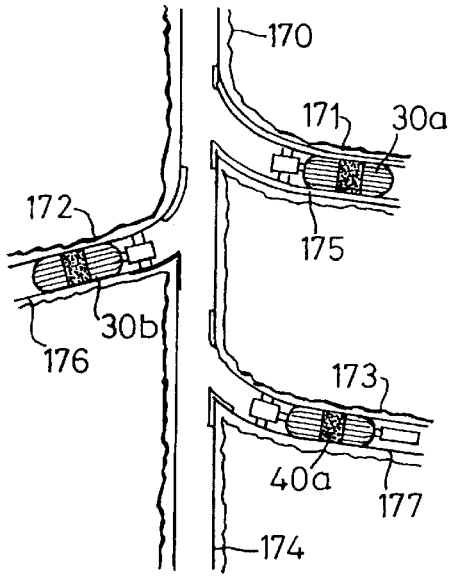
FIGS. 12A–12C are schematic side views of systems according to the present invention.

FIG. 12A shows a main wellbore 170 with lateral wellbores 171, 172, and 173 extending out therefrom. The main wellbore is cased with casing 174 and the lateral wellbores have liners 175, 176, and 177. A system 30*a* (like the system 30) has been anchored in the liner 175 to close off lateral wellbore 171. A system 30*b* (like the system 30) has been anchored in the liner 176 to close off lateral wellbore 172. A system 40*a* (like the system 40) has been anchored in liner 177 to close off lateral wellbore 173. The sealing packer in the system in each liner has been activated to seal off its respective liner to fluid flow. In one aspect each system (two of them, or all systems) may be selectively re-accessed to deactivate the anchor, and deflate the packer to re-establish communication between a lateral wellbore and the main wellbore. Optionally, the main wellbore may be closed off (e.g. with a system as in FIGS. 2, 4, 5, 6, 7A, 8A, 8B, 9, 10B or 10D) and/or one of the laterals may be opened up and/or a new lateral may be drilled (following milling of a window for the new lateral e.g. with a whipstock system and/or mill system as disclosed herein).

Figure 12C:
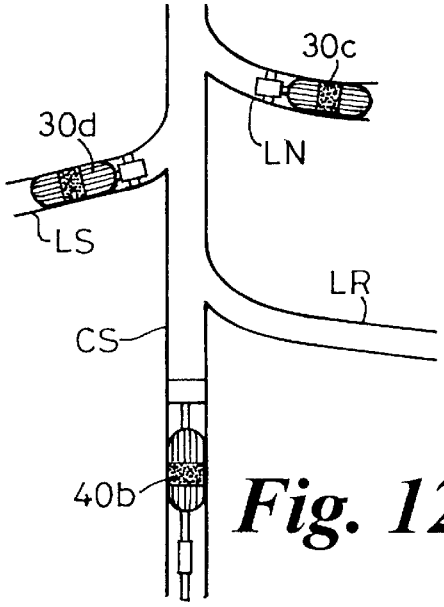
Figure 12B:
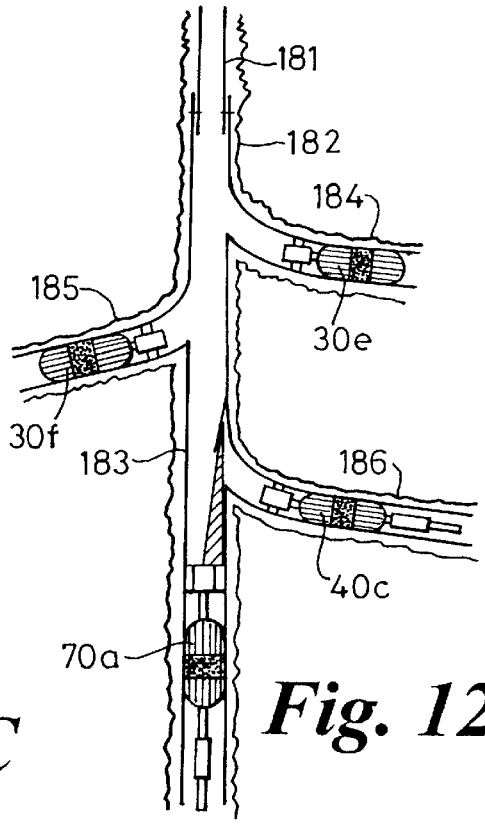

FIG. 12B shows a system 70*a* according to the present invention which is like the system 70, FIG. 7A. The system 70*a* is a "through tubing" system that has been inserted through tubing 181 that extends from the earth surface or from a hanger from another string in an earth wellbore 182. A tubular string 183 with a larger diameter than the tubing 181 extends down beyond the lower end of the tubing 181. Three lined lateral wellbores 184, 185, 186 branch off from the main wellbore 182. Systems 30*e*, 30*f*, (both like the system 30, FIG. 4) and 40*c* (like the system 40, FIG. 5) close off the lateral wellbores. The system 70*a* has been selectively anchored with its whipstock 70*b* oriented so that it can divert a mill or mill drill to create a window through the casing and/or start a new lateral wellbore at a desired location. Any or all of the components of the system 70*a* may be retrievable.

It is within the scope of this invention for the anchor, packer, and thermal compensator of the system 70*a* to be installed in a first trip into the main wellbore 182 and then to orient and install the whipstock on the anchor in a second trip. Optionally the mill or mill-drill (not shown) can be releasably attached to the whipstock of the system 70*a* so that another trip to introduce the mill or mill-drill is not necessary.

FIG. 12C schematically illustrates a wellbore combination as in FIG. 12A but with a casing CS in a main wellbore (not shown, like the main wellbore 174, FIG. 12A) closed off beneath liner LR in a lateral wellbore (not shown, like the lateral wellbore 173, FIG. 12A) with a system 40*b* (like the system 40). The string that was used to install the system 40*b* (like the string 47 or coiled tubing, wireline, etc.) has been released from the system 40*b* and removed from the main wellbore. Systems 30*c* and 30*d* close off liners LN and LS, respectively (like liners 175, 176, FIG. 12A) in lateral wellbores (not shown, like wellbores 171, 172, FIG. 12A).

Figure 13A:
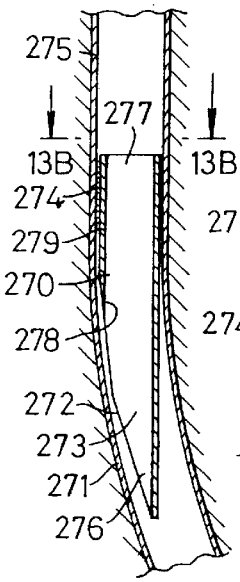
FIG. 13A is a side view in cross-section of a mill guide according to the present invention anchored in a wellbore casing.
Figure 13B:
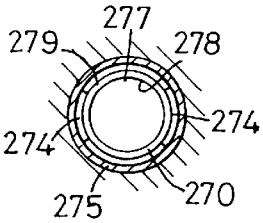
FIG. 13B is a top end cross-sectional view of the mill guide and casing of FIG. 13A.

FIGS. 13A and 13B show a mill guide 270 according to the present invention with a hollow cylindrical body 279 having a bore 278 therethrough, an open top end 277 and an open bottom end 276. The mill guide 270 is disposed in a piece of casing 275 which is part of a string of casing (not shown) in a wellbore in the earth. An anchor 274 (or anchors) holds the mill guide 270 in place at a desired location in the casing with an opening 273 of the mill guide's bottom end 276 disposed and oriented so that a mill passing through the mill guide 270 will mill a desired area of the casing, creating a desired hole, slot, opening, or window. The bottom end 276 of the mill guide 270 is formed or cut to have a desired shape 272. This shape 272 may be made to correspond to a curved portion 271 of the casing 275.

Figure 13C:
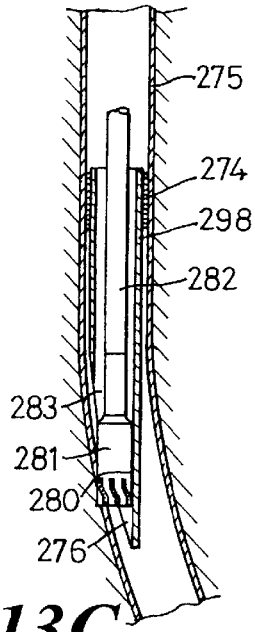
FIG. 13C is a side cross-sectional view of an operation with the mill guide of FIG. 13A.

As shown in FIG. 13C, a mill 281 on a string of drill pipe 282 has been introduced through the casing 275 and the mill guide 270 to contact the casing 275 and begin to mill a hole therethrough. A body 283 of the mill 281 has a length such that at least about a fourth of the desired opening is milled (and in other aspects substantially all of the desired opening) while the mill body 283 remains in contact with a side 280 of the bottom end 276 of the mill guide 270, thus providing a continuous reaction support during part or substantially all of the milling. The side 280 may be the same thickness as a side 298 which is shorter than the side 280; or the side 280 may be thicker than the side 298. The interior of the 30 side 280 may one or more additional layers of material thereon. Such material may also inhibit the mill from milling the side 280. This additional material may be any desired practical thickness and may be any known suitable material, including, but not limited to, steel, carbide steel, stainless steel, known alloys, and hardfacing material. Such a layer or layers may be added by any known method (e.g., welding or hardfacing) or may be formed integrally of the side 280.

Figure 13D:
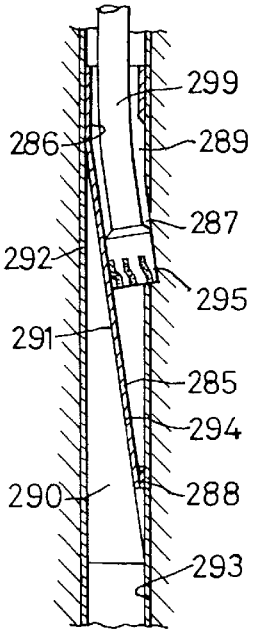
FIG. 13D is a side view, partially in cross-section of a mill guide system according to the present invention.

FIG. 13D shows a mill guide 285 with a hollow body 286, a top open end 296, a bottom end point 288, a side opening 289, and a slanted side member 291. A whipstock 290 disposed in a casing 292 in a wellbore 293 has a concave surface 294 which corresponds to the shape of the slanted side member 291. The mill guide 285 is made of a strong metal, e.g. steel, so that the slanted side member 291 protects the concave surface 294 from the effects of a mill 295 on flexible pipe 299. The whipstock 290 and the side opening 289 are positioned so that a window 287 is cut at a desired location on the casing 282. As shown in FIG. 13D the window 287 has only been partially milled and will be completed as the mill 295 moves down the slanted side member 291. It is within the scope of this invention for the mill guide 285 and the whipstock 290 to be connected together; to be formed integrally as one member; or for the mill guide 285 to be releasably connected to the whipstock (e.g. but not limited to, by one or more shear studs or shear lugs). In another aspect the mill guide and the whipstock are installed separately. The mills in FIGS. 13A–14 may be any mill disclosed in U.S. application Ser. No. 08/962,162, in any of its parent applications; or any suitable wellbore mill or mill systems.

Figure 13E:
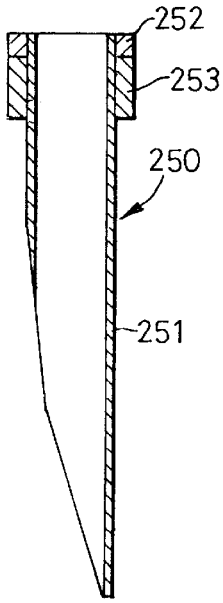
FIG. 13E is a side view in cross-section of a mill guide according to the present invention.

FIG. 13E discloses a mill guide system 250 with a mill guide 251 (like the mill guide of FIG. 13A) with a fluid activated anchor (or anchors) 252 (like the anchor or anchors 274) and a thermal compensator 253 for maintaining a desired fluid pressure in the anchor 252.

Figure 13F:
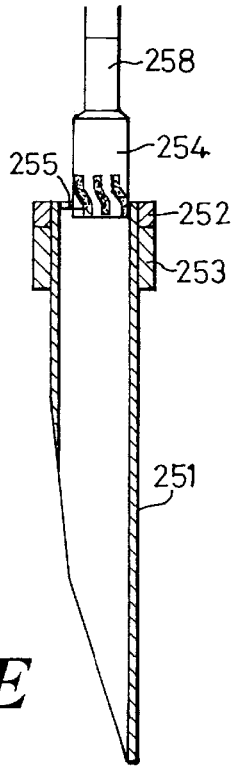
FIG. 13F is a side view in cross-section of a mill system according to the present invention with a mill guide.

FIG. 13F discloses a system like that of FIG. 13E and like numerals indicate like parts. A mill 254 is releasably secured to the mill guide 251 by, e.g., a shear pin 255. The mill 254 represents, within the scope of this invention, any known suitable mill, mills or milling system. The mill 254 is connected to a rotatable wellbore string 258 that can extend from an earth surface to a location in a wellbore. Alternatively, as with any mill or mill-drill herein, a downhole motor may be used to rotate the mill or mill-drill.

Figure 14:
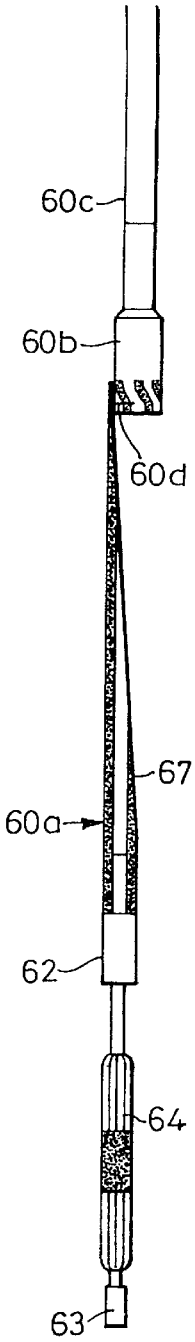
FIG. 14 is a side schematic view of a wellbore mill system according to the present invention.
Figure 15A:
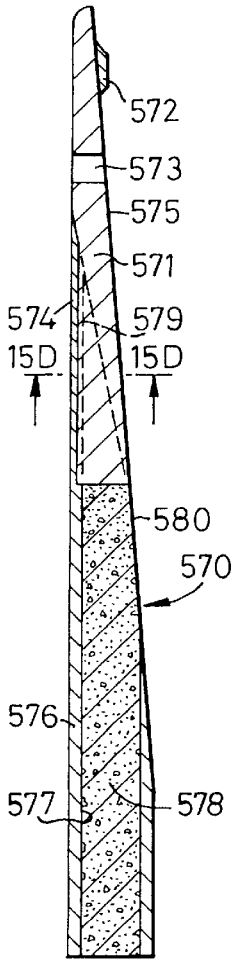
FIG. 15A is a side view in cross-section of a whipstock according to the present invention.
Figure 15B:
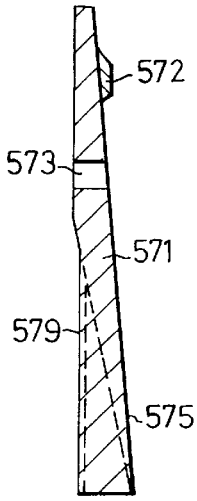
FIGS. 15B and 15C are partial views of the whipstock of FIG. 15A.
Figure 15D:
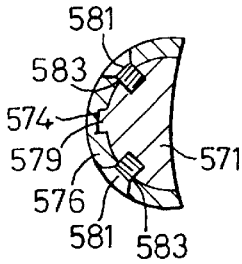
FIG. 15D is a cross-section view along line 15D—15D of FIG. 15A.
Figure 15C:
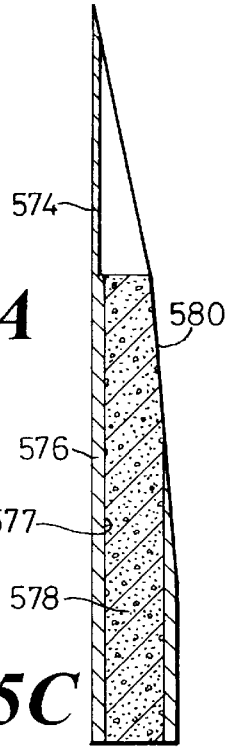

FIG. 14 discloses a system 60*a* like the system 60, FIG. 6 (and numerals indicate the same parts) with a mill 60*b* (like the mill 254 or its alternatives) connected to a rotatable string 60*c* like the string 258 or its alternatives). The mill 60*b* is selectively releasably secured to the whipstock 67. A shear stud 60*d* 1 releasably secures the mill 60*b* to the whipstock 67.

FIG. 15A–15D shows a whipstock 570 according to the present invention which has a top solid part 571 releasably connected to a hollow lower part 576. The top solid part 571 has a pilot lug 572, a retrieval hook hole 573, a concave inclined surface 575 and a rail 579. The lower hollow part 576 has an inner bore 577 shown filled with drillable filler material or cement 578. The cement is in the tool as it is inserted into the casing. The lower hollow part 576 has a concave inclined surface 580 which lines up with the concave inclined surface 575 of the top solid part 571. Shear screws 581 extend through holes 583 in the lower hollow part 576 and holes 582 in the top solid part 571 to releasably hold the two parts together. The rail 579 is received in a corresponding groove 574 in the lower hollow part 576 to insure correct combination of the two parts. Preferably the length of the top solid part is at least 50% of the length of the inclined portion of the concave. A whipstock 570 maybe used in any system disclosed herein. Upon completion of an operation, the top solid part is released by shearing the shear screws with an upward pull on the whipstock, making retrieval and re-use of the top solid part possible. The bottom hollow part need never leave the wellbore.

Figure 16A:
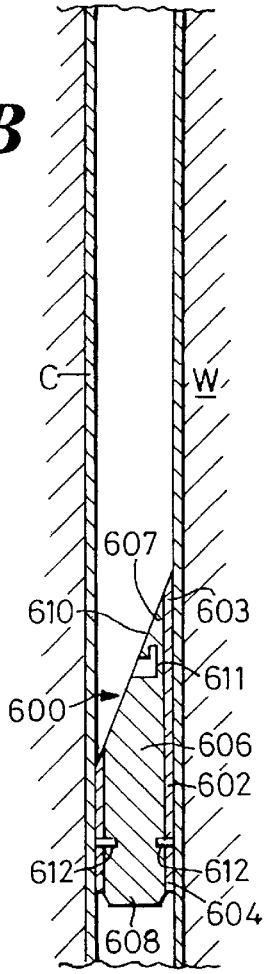
FIGS. 16A and 16B are side views in cross-section of a system according to the present invention.
Figure 16B:
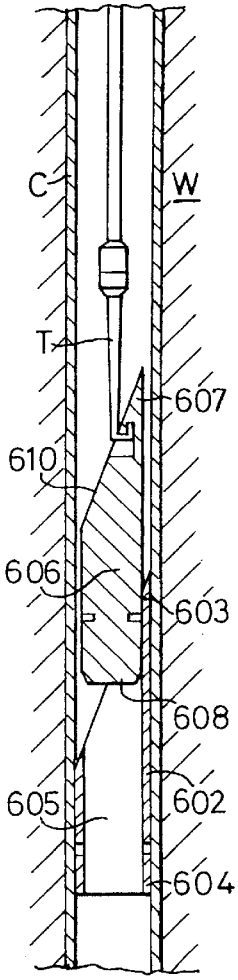

FIGS. 16A and 16B illustrate a whipstock 600 according to the present invention in a casing C in a wellbore. The whipstock 600 has an outer hollow tubular member 602 having a top end 603, a bottom end 604 and a central bore 605; and an inner solid member 606 with a top end 607, a bottom end 608, a concave 609 with a concave inclined surface 610, and a retrieval hook slot 611 in the concave 609. The hollow tubular member 602 is secured to the casing and, while in use, the inner solid member 606 is releasably secured to the outer hollow tubular member 602, e.g. by shear pins 612 extending from the inner solid member 606 into the outer hollow tubular member 602. As shown in FIG. 16B, upon shearing of the pins 612 by an upward pull with a retrieval tool T, the retrieval tool T is used to remove the inner solid member 606 for re-use.

Figure 17A:
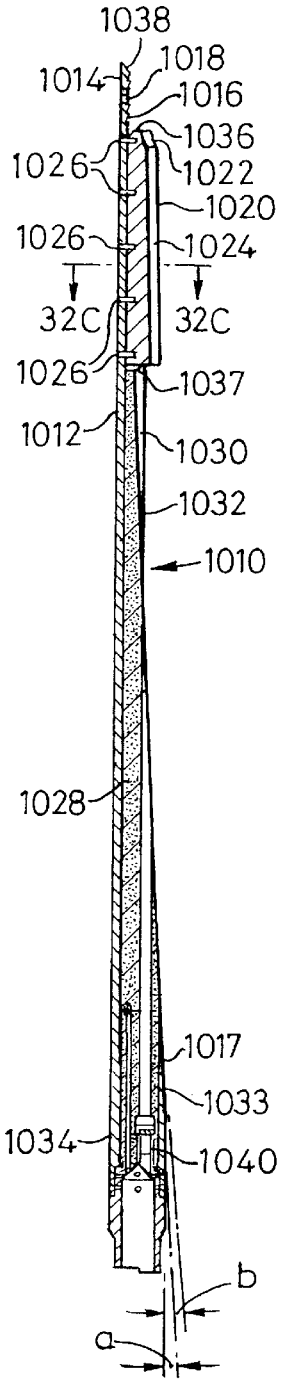
FIG. 17A is a side view in cross section of a system according to the present invention.

FIG. 17A shows a system 1010 according to the present invention having a whipstock body 1012, a sacrificial element 1020 with two guiding faces secured to the whipstock body 1012 with bolts 1026, filler 1028 in a recess 1030 of the body 1012, and a plug element 1040 in a bottom 1034 of the whipstock body 1012.

A top 1014 of the whipstock body 1012 extends above the sacrificial element 1020 (preferably made of readily millable material, e.g. brass, bronze, composite material, iron, cast iron, typical relatively soft bearing materials, soft steels, fiberglass, aluminum, zinc, other suitable metals, or alloys or combinations thereof) and has a sloped ramp 1038. One-way teeth 1016 are formed in the top 1014 so that a member (not shown) with corresponding teeth may push down on the whipstock body 1012 so that exerted force is transmitted from the corresponding teeth of the member to the whipstock body 1012 and so that the teeth 1016 and the corresponding teeth on the member slide apart when pulling up on the member with sufficient force. A hole 1018 provides an opening for receiving a connector to connect the member to the whipstock body 1012.

The first face 1022 of the sacrificial element 1020 is slanted so that a mill with an appropriate corresponding ramped portion contacts the first face 1022 and is directed away from the whipstock body 1012 (at an angle of between 5° to 25° and in one aspect about 15° from the central longitudinal axis of the body) e.g. to commence milling of a tubular (not shown), e.g. casing or tubing, in which the system 1010 is anchored. Any suitable known anchor device may be used. The second face 1024 is configured, sized and disposed for further direction of a mill away from the whipstock body 1012 as it mills the tubular.

In one aspect as a mill moves down against the sacrificial element 1020, it mills a portion of the sacrificial element 1020 rather than milling the whipstock body 1012. A third face 1032 includes sides or "rails" of the whipstock body 1012 which are sufficiently wide and strong to guide a mill moving downwardly adjacent the whipstock. A fourth face 1033 extends below the third face 1032. In one aspect the fourth face 1033 is straight and the third face 1032 is a chord of a circle. The first, second, third, and fourth faces may each be straight or curved (e.g. a chord of a circle) as desired and either inclined at any desired angle in a straight line away from a longitudinal axis of the body or curved as a chord of any desired circle.

Figure 17B:
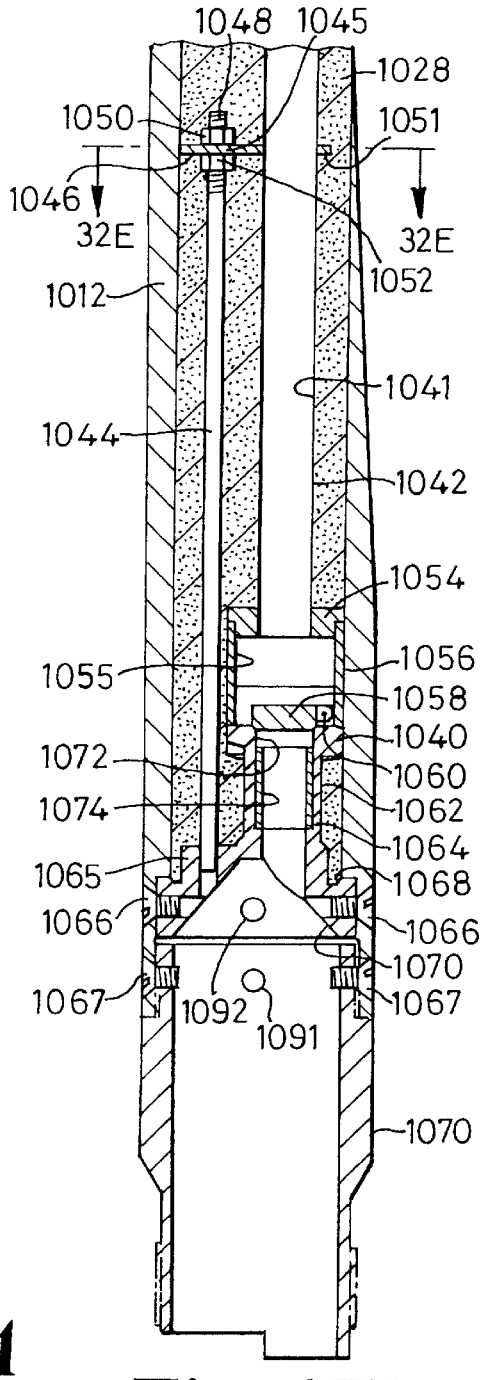
FIG. 17B is an enlargement of part of the system of FIG. 17A.

The plug element 1040 is secured in the bottom 1034 of the whipstock body 1012. The plug element 1040 retains the filler 1028 within the recess 1032. Via a channel 1041 through a tube 1042 (e.g. made of readily millable material), a channel 1055 through a valve body 1056 (e.g. made of readily millable material), a channel 1072 through a body 1062, and a sleeve 1074 in a body 1064, fluid flow through the plug element 1040 is possible when a valve member 1058 rotates upwardly about a pivot 1060. As shown in FIG. 17B the valve member 1058 is closing off fluid flow from above the plug element 1040 to beneath it, either due to the fact that there is little or no fluid flow and gravity holds the valve member 1058 down or the force of fluid flow from below into the channel 1072 is insufficient to overcome the weight of fluid on top of the valve member 1058. Epoxy or some other suitable adhesive may be used to hold the body 1062, body 1064, and sleeve 1074 together.

In one particular embodiment sacrificial element 1020 is about 30 inches long (excluding the extending top part with teeth) and the blade sets of the mill 1200 are spaced apart about two feet and the nose 1240 is about 18 inches from its lower end to the first set of blades 1231. With such a mill a completed initial window is about 60 inches long. It is within the scope of certain preferred embodiments of this invention for the initial window through the casing to be two, three, four, five, six, seven or more feet long.

Figure 18:
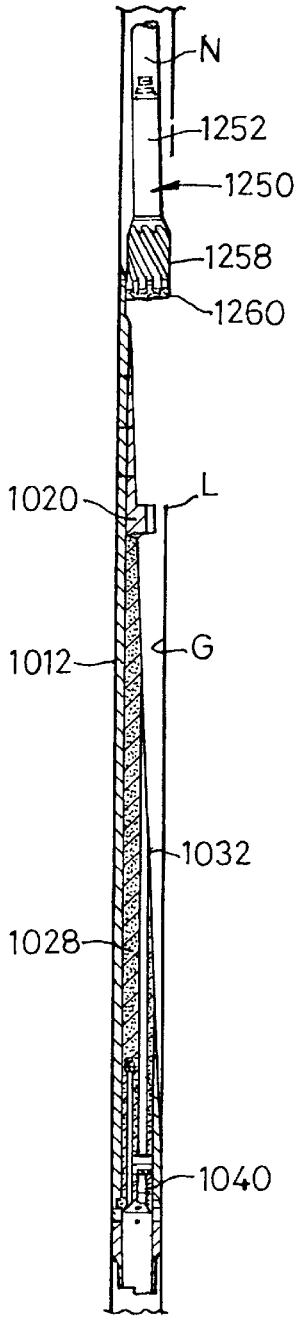
FIGS. 18 is a side cross-section view of a mill system according to the present invention.

FIG. 18 shows a mill system with a window mill 1250 for use to enlarge the window made by a mill. The window mill 1250 has a body with a fluid flow channel from top to bottom and jet ports to assist in the removal of cuttings and debris. A plurality of blades present a smooth finished surface which moves along what is left of the sacrificial element 1020 (e.g. one, two, three up to about twelve to fourteen inches) and then on the filler 1028 and the edges of whipstock body that define the recess 1030 with little or no milling of the filler 1028 and of the edges of the whipstock body 1012 which define the recess 1030. Lower ends of the blades and a lower portion of the body are dressed with milling material 1260 (e.g. but not limited to known milling matrix material and/or known milling/cutting inserts applied in any known way, in any known combination, and in any known pattern or array).

In one aspect the lower end of the body of the mill tapers inwardly an angle to inhibit or prevent the window mill lower end from contacting and milling the filler 1028 and whipstock body 1012.

In one method according to the present invention a mill (such as the window mill 1250) mills down the whipstock, milling a window. Following completion of the desired window in the casing and removal of the window mill, a variety of sidetracking operations may be conducted through the resulting window (and, in some aspects, in and through the partial lateral wellbore milled out by the mill as it progressed out from the casing). In such a method the remaining portion of the whipstock is left in place and may, if desired be milled out so that the main original wellbore is again opened. In one aspect the filler 1028 and plug element 1040 are milled out to provide an open passage through the whipstock.

In another aspect, in the event there is a problem in the milling operation prior to completion of the window, the whipstock is removed.

As shown in FIG. 18, the mill 1250 has been run into a wellbore, not shown, and a window has been started in casing G. E.g. the mill is on a tubular string N of, e.g. a drill string of drill pipe to be rotated from above or to be rotated with a downhole motor as described above). The inwardly tapered portion 1260 of the body of the mill 1250 preferably does not mill the top of the whipstock body 1012 or mills it minimally. The mill 1250 proceeds down along the remainder of the sacrificial element 1020 with the mill surface 1258 holding the milling end away from the sacrificial element and directing the mill 1250 away from the body 1012 toward the casing G. The inwardly tapered portion of the mill 1250 encounters a ledge L created by the first mill, and due to the inwardly tapered portion, the mill moves outwardly with respect to the ledge L, begins to mill the casing G, and also begins to mill the remainder of the sacrificial element 1020. The surface 1258 will continue to co-act with the resulting milled surface on the sacrificial element 1020 until the surface 1258 is no longer in contact with the sacrificial element 1258 as the mill 1250 mills down the casing G. Thus the window, (at the point at which the mill 1250 ceases contact with the sacrificial element 1020) that includes the initial window formed by the mill 1200 and the additional portion milled by the mill 1250 is created without the mills contacting the whipstock body 1012 or the filler 1028.

Any whipstock shown in any system disclosed herein, e.g. those of FIGS. 6, 7A, 10B and 12B may be hollow with filler (e.g., but not limited to, as in FIGS. 17A or 15A) and/or retrievable (e.g., but not limited to, as in FIG. 16B).

It is within the scope of this invention to provide the major components of the systems of FIGS. 2–10 and 12 as interchangeable modules and for each apparatus, e.g. a packer, to itself have a variety of interchangeable modules (e.g. different packers), depending on a particular job.

The present invention, therefore, provides in at least certain preferred embodiments a wellbore apparatus including anchor apparatus for anchoring the wellbore apparatus in a bore, the anchor apparatus actuated by fluid under pressure supplied thereto, and sealing apparatus selectively inflatable to close off the bore to fluid flow therethrough. Such a wellbore apparatus may have one, some, any combination of the following: wherein the anchor apparatus is connected to and in fluid communication with a tubular string for lowering the wellbore apparatus down into the bore and the fluid under pressure for actuating the anchor apparatus and the sealing apparatus is supplied through the tubular string; a pump in fluid communication with and interconnected with the anchor apparatus for pumping fluid under pressure to the anchor apparatus to actuate the anchor apparatus and to the sealing apparatus to inflate the sealing apparatus; a wellbore wireline connected to the pump for lowering the wellbore apparatus down into the bore; wherein the pump is selectively releasably connected to the anchor apparatus; wherein the pump carries a charge of fluid for pumping under pressure to supply the fluid under pressure; wherein the fluid under pressure is hydraulic fluid; wherein the anchor apparatus is releasably connected to the sealing apparatus; wherein the anchor apparatus has a plurality of selectively extendable members movable in response to the fluid under pressure to anchor the anchor apparatus in the bore; wherein the plurality of selectively extendable members are movable to concentrically anchor the anchor apparatus centered within the bore; wherein the bore is a wellbore or a bore through a tubing, e.g. but not limited to casing, tubing and liners; orienting apparatus for orienting the anchor apparatus to a desired orientation within the bore; wherein the orienting apparatus includes a measurement while drilling device; wherein the anchor apparatus is connected to coiled tubing for lowering the wellbore apparatus down into the bore; wherein the sealing apparatus is an inflatable sealing packer; whipstock apparatus connected to the anchor apparatus; orienting apparatus for orienting the whipstock to a desired orientation within the bore; wherein the orienting apparatus includes measurement while drilling apparatus; wherein the whipstock apparatus is retrievable from within the bore; wherein the whipstock apparatus is hollow and filled with drillable or millable filler material; wherein the whipstock, anchor apparatus and sealing apparatus are configured and sized for through-tubing wellbore operations; temperature compensating apparatus for maintaining a desired fluid pressure in the anchor apparatus and/or in the sealing apparatus; wherein the temperature compensating apparatus comprises a cylinder in which is displaceably positioned a reciprocatingly slidable piston which is movable in response to fluid pressure variations and which has a cavity in fluid communication with a cavity of said cylinder, the piston having a first piston surface which is influenced by the fluid pressure inside the sealing apparatus, and a second piston surface facing a direction opposite the first piston surface which second piston surface is influenced by fluid pressure in the bore, the two piston surfaces having mutually different areas, the temperature compensator arranged to regulate, on the basis of said difference in piston surface area, internal fluid pressure in the sealing apparatus in relating to ambient fluid pressure effective downstream of the sealing apparatus and thus constituting a reference pressure for the internal pressure of the sealing apparatus; wellbore milling apparatus selectively releasably connected to the whipstock apparatus; wherein the wellbore milling apparatus, whipstock apparatus, anchor apparatus and sealing apparatus are configured and sized for through-tubing wellbore operations; wherein the anchor apparatus is effective to anchor the wellbore apparatus, and the sealing apparatus is effective to seal the bore to create a primary barrier in the bore; wherein the wellbore milling apparatus is from the group consisting of: a starter mill; a window mill; a combination of a plurality of at least two mills; at least one watermelon mill; and a milling-drilling apparatus; wherein the whipstock apparatus has a channel therethrough and valve apparatus for controlling fluid flow through the channel; and/or wherein the anchor apparatus and sealing apparatus can be selectively deactivated for retrieval from the bore.

The present invention, therefore, provides in at least certain preferred embodiments a wellbore apparatus with sealing apparatus for selectively closing off a bore to fluid flow, the sealing apparatus inflatable by fluid under pressure, and temperature compensation apparatus for maintaining fluid under pressure in the sealing apparatus at a desired pressure.

The present invention, therefore, provides in at least certain preferred embodiments a wellbore apparatus having anchor apparatus for selectively anchoring in a bore the anchor apparatus actuatable by fluid under pressure, and temperature compensation apparatus for maintaining fluid under pressure in the sealing apparatus at a desired pressure. Such wellbore apparatus may include a mill guide connected to the anchor apparatus, and, in certain aspects, mill apparatus selectively releasably connected to the mill guide.

The present invention, therefore, provides in at least certain preferred embodiments a multi-bore wellbore system having a main wellbore cased with casing, at least one lined lateral wellbore extending from and in fluid communication with the main wellbore, at least one of the casing of the main wellbore and the at least one lined lateral wellbore closed off by a primary barrier comprising a wellbore apparatus comprising anchor apparatus for anchoring the wellbore apparatus in a bore, the anchor apparatus actuated by fluid under pressure supplied thereto, and sealing apparatus selectively inflatable to close off the bore to fluid flow therethrough; such a multi-bore wellbore system wherein tubing is above and in fluid communication with the casing of the main wellbore and the primary barrier is configured and sized for passage through the tubing into the main wellbore, the tubing smaller in diameter than diameter of the main wellbore; such a multi-bore wellbore system wherein the primary barrier is selectively deactivatable and retrievable; and/or such a multi-bore wellbore system wherein the wellbore apparatus has temperature compensating apparatus for maintaining a desired fluid pressure in the anchor apparatus and in the sealing apparatus.

The present invention, therefore, provides in at least certain preferred embodiments a method for closing off a bore in a well, the method including installing wellbore apparatus in the bore, the wellbore apparatus comprising anchor apparatus for anchoring the wellbore apparatus in a bore, the anchor apparatus actuated by fluid under pressure supplied thereto, and sealing apparatus interconnected with the anchor apparatus and selectively inflatable with fluid under pressure to close off the bore to fluid flow therethrough, the wellbore apparatus upon anchoring in the bore and inflation of the sealing apparatus comprising a primary barrier in the bore.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A wellbore apparatus comprising anchor apparatus for anchoring the wellbore apparatus in a bore, the anchor apparatus actuated by fluid under pressure supplied thereto, sealing apparatus selectively inflatable to close off the bore to fluid flow therethrough, and whipstock apparatus connected to the anchor apparatus.

2. The wellbore apparatus of claim 1 wherein the anchor apparatus is connected to and in fluid communication with a tubular string for lowering the wellbore apparatus down into the bore and the fluid under pressure for actuating the anchor apparatus and the sealing apparatus is supplied through the tubular string.

3. The wellbore apparatus of claim 1 wherein the anchor apparatus is releasably connected to the sealing apparatus.

4. The wellbore apparatus of claim 1 further comprising orienting apparatus for orienting the anchor apparatus to a desired orientation within the bore.

5. The wellbore apparatus of claim 4 wherein the orienting apparatus includes a measurement while drilling device.

6. The wellbore apparatus of claim 1 wherein the anchor apparatus is connected to coiled tubing for lowering the wellbore apparatus down into the bore.

7. The wellbore apparatus of claim 1 wherein the sealing apparatus is an inflatable sealing packer.

8. The wellbore apparatus of claim 1 further comprising orienting apparatus for orienting the whipstock to a desired orientation within the bore.

9. The wellbore apparatus of claim 8 wherein the orienting apparatus includes measurement while drilling apparatus.

10. The wellbore apparatus of claim 1 wherein the whipstock apparatus is retrievable from within the bore.

11. The wellbore apparatus of claim 1 wherein the whipstock apparatus is hollow and filled with drillable or millable filler material.

12. The wellbore apparatus of claim 1 wherein the whipstock, anchor apparatus and sealing apparatus are configured and sized for through-tubing wellbore operations.

13. The wellbore apparatus of claim 1 further comprising temperature compensating apparatus for maintaining a desired fluid pressure in the anchor apparatus.

14. The wellbore apparatus of claim 1 further comprising temperature compensating apparatus for maintaining a desired fluid pressure in the sealing apparatus.

15. The wellbore apparatus of claim 1 further comprising wellbore milling apparatus selectively releasably connected to the whipstock apparatus.

16. The wellbore apparatus of claim 15 wherein the wellbore milling apparatus, whipstock apparatus, anchor apparatus and sealing apparatus are configured and sized for through-tubing wellbore operations.

17. The wellbore apparatus of claim 15 wherein the wellbore milling apparatus is from the group consisting of: a starter mill; a window mill; a combination of a plurality of at least two mills; at least one watermelon mill; and a milling-drilling apparatus.

18. The wellbore apparatus of claim 1 wherein the whipstock apparatus has a channel therethrough and valve apparatus for controlling fluid flow through the channel.

19. The wellbore apparatus of claim 1 wherein the anchor apparatus and sealing apparatus can be selectively deactivated for retrieval from the bore.

20. A wellbore apparatus comprising anchor apparatus for anchoring the wellbore apparatus in a bore, the anchor apparatus actuated by fluid under pressure supplied thereto, and sealing apparatus selectively inflatable to close off the bore to fluid flow therethrough, orienting apparatus for orienting the anchor apparatus to a desired orientation within the bore, and wherein the orienting apparatus includes a measurement while drilling device.

21. A wellbore apparatus comprising anchor apparatus for selectively anchoring in a bore the anchor apparatus actuatable by fluid under pressure, temperature compensation apparatus for maintaining fluid under pressure in the sealing apparatus at a desired pressure, and wherein the temperature compensating apparatus comprises a cylinder in which is displaceably positioned a reciprocatingly slidable piston which is movable in response to fluid pressure variations and which has a cavity in fluid communication with a cavity of said cylinder, the piston having a first piston surface which is influenced by the fluid pressure inside the sealing apparatus, and a second piston surface facing a direction opposite the first piston surface which second piston surface is influenced by fluid pressure in the bore, the two piston surfaces having mutually different areas, the temperature compensator arranged to regulate, on the basis of said difference in piston surface area, internal fluid pressure in the sealing apparatus in relating to ambient fluid pressure effective downstream of the sealing apparatus and thus constituting a reference pressure for the internal pressure of the sealing apparatus.

22. The wellbore apparatus of claim 21 further comprising a mill guide connected to the anchor apparatus.

23. The wellbore apparatus of claim 22 further comprising mill apparatus selectively releasably connected to the mill guide.

24. A wellbore apparatus comprising anchor apparatus for anchoring the wellbore apparatus in a bore, the anchor apparatus actuated by fluid under pressure supplied thereto, sealing apparatus selectively inflatable to close off the bore to fluid flow therethrough, temperature compensating apparatus for maintaining a desired fluid pressure in the sealing apparatus, and orienting apparatus for orienting the anchor apparatus to a desired orientation within the bore, wherein the orienting apparatus includes a measurement while drilling device.

25. A wellbore apparatus comprising anchor apparatus for anchoring the wellbore apparatus in a bore, the anchor apparatus actuated by fluid under pressure supplied thereto, sealing apparatus selectively inflatable to close off the bore to fluid flow therethrough, temperature compensating apparatus for maintaining a desired fluid pressure in the sealing apparatus, and whipstock apparatus connected to the anchor apparatus.

26. The wellbore apparatus of claim 25 further comprising orienting apparatus for orienting the whipstock to a desired orientation within the bore.

27. The wellbore apparatus of claim 26 wherein the orienting apparatus includes measurement while drilling apparatus.

28. The wellbore apparatus of claim 25 wherein the whipstock apparatus is retrievable from within the bore.

29. The wellbore apparatus of claim 25 wherein the whipstock apparatus is hollow and filled with drillable or millable filler material.

30. The wellbore apparatus of claim 25 wherein the whipstock, anchor apparatus and sealing apparatus are configured and sized for through-tubing wellbore operations.

31. The wellbore apparatus of claim 25 further comprising temperature compensating apparatus for maintaining a desired fluid pressure in the anchor apparatus.

32. The wellbore apparatus of claim 25 wherein the temperature compensating apparatus comprises a cylinder in which is displaceably positioned a reciprocatingly slidable piston which is movable in response to fluid pressure variations and which has a cavity in fluid communication with a cavity of said cylinder, the piston having a first piston surface which is influenced by the fluid pressure inside the sealing apparatus, and a second piston surface facing a direction opposite the first piston surface which second piston surface is influenced by fluid pressure in the bore, the two piston surfaces having mutually different areas, the temperature compensator arranged to regulate, on the basis of said difference in piston surface area, internal fluid pressure in the sealing apparatus in relating to ambient fluid pressure effective downstream of the sealing apparatus and thus constituting a reference pressure for the internal pressure of the sealing apparatus.

33. The wellbore apparatus of claim 25 further comprising wellbore milling apparatus selectively releasably connected to the whipstock apparatus.

34. The wellbore apparatus of claim 33 wherein the wellbore milling apparatus, whipstock apparatus, anchor apparatus and sealing apparatus are configured and sized for through-tubing wellbore operations.

35. The wellbore apparatus of claim 25 wherein the anchor apparatus is effective to anchor the wellbore apparatus, and the sealing apparatus is effective to seal the bore to create a primary barrier in the bore.

36. The wellbore apparatus of claim 33 wherein the wellbore milling apparatus is from the group consisting of: a starter mill; a window mill; a combination of a plurality of at least two mills; at least one watermelon mill; and a milling-drilling apparatus.

37. The wellbore apparatus of claim 25 wherein the whipstock apparatus has a channel therethrough and valve apparatus for controlling fluid flow through the channel.

38. The wellbore apparatus of claim 25 wherein the anchor apparatus and sealing apparatus can be selectively deactivated for retrieval from the bore.

39. The wellbore apparatus of claim 25 wherein the anchor apparatus is connected to and in fluid communication with a tubular string for lowering the wellbore apparatus down into the bore and the fluid under pressure for actuating the anchor apparatus and the sealing apparatus is supplied through the tubular string.

40. The wellbore apparatus of claim 25 further comprising a pump in fluid communication with and interconnected with the anchor apparatus for pumping fluid under pressure to the anchor apparatus to actuate the anchor apparatus and to the sealing apparatus to inflate the sealing apparatus.

41. The wellbore apparatus of claim 40 further comprising a wellbore wireline connected to the pump for lowering the wellbore apparatus down into the bore.

42. The wellbore apparatus of claim 40 wherein the pump is selectively releasably connected to the anchor apparatus.

43. The wellbore apparatus of claim 40 wherein the pump carries a charge of fluid for pumping under pressure to supply the fluid under pressure.

44. The wellbore apparatus of claim 25 wherein the fluid under pressure is hydraulic fluid.

45. The wellbore apparatus of claim 25 wherein the anchor apparatus is releasably connected to the sealing apparatus.

46. The wellbore apparatus of claim 25 wherein the anchor apparatus has a plurality of selectively extendable members movable in response to the fluid under pressure to anchor the anchor apparatus in the bore.

47. The wellbore apparatus of claim 46 wherein the plurality of selectively extendable members are movable to concentrically anchor the anchor apparatus centered within the bore.

48. The wellbore apparatus of claim 25 wherein the bore is a wellbore.

49. The wellbore apparatus of claim 25 wherein the bore is a bore within a tubular in a wellbore.

50. The wellbore apparatus of claim 25 wherein the anchor apparatus is connected to coiled tubing for lowering the wellbore apparatus down into the bore.

51. The wellbore apparatus of claim 25 wherein the sealing apparatus is an inflatable sealing packer.

52. A multi-bore wellbore system comprising a main wellbore cased with casing, at least one lined lateral wellbore extending from and in fluid communication with the main wellbore, at least one of the casing of the main wellbore and the at least one lined lateral wellbore closed off by a primary barrier comprising a wellbore apparatus comprising anchor apparatus for anchoring the wellbore apparatus in a bore, the anchor apparatus actuated by fluid under pressure supplied thereto, and sealing apparatus selectively inflatable to close off the bore to fluid flow therethrough, temperature compensating apparatus for maintaining a desired fluid pressure in the anchor apparatus and in the sealing apparatus, and whipstock apparatus connected to the anchor apparatus, and wherein the temperature compensating apparatus comprises a cylinder in which is displaceably positioned a reciprocatingly slidable piston which is movable in response to fluid pressure variations and which has a cavity in fluid communication with a cavity of said cylinder, the piston having a first piston surface which is influenced by the fluid pressure inside the sealing apparatus, and a second piston surface facing a direction opposite the first piston surface which second piston surface is influenced by fluid pressure in the bore, the two piston surfaces having mutually different areas, the temperature compensator arranged to regulate, on the basis of said difference in piston surface area, internal fluid pressure in the sealing apparatus in relating to ambient fluid pressure effective downstream of the sealing apparatus and thus constituting a reference pressure for the internal pressure of the sealing apparatus.

53. The multi-bore wellbore system of claim 52 wherein tubing is above and in fluid communication with the casing of the main wellbore and the primary barrier is configured and sized for passage through the tubing into the main wellbore, the tubing smaller in diameter than diameter of the main wellbore.

54. The multi-bore wellbore system of claim 12 wherein the primary barrier is selectively deactivatable and retrievable.

* * * * *